US009074353B2

(12) United States Patent
Tanaka et al.

(10) Patent No.: US 9,074,353 B2
(45) Date of Patent: Jul. 7, 2015

(54) EXCAVATING BUCKET FOR CONSTRUCTION MACHINE

(71) Applicant: KOMATSU LTD., Tokyo (JP)

(72) Inventors: Daijirou Tanaka, Hirakata (JP); Daijirou Itou, Hirakata (JP)

(73) Assignee: KOMATSU LTD., Tokyo (JP)

( * ) Notice: Subject to any disclaimer, the term of this patent is extended or adjusted under 35 U.S.C. 154(b) by 0 days.

(21) Appl. No.: 14/345,487

(22) PCT Filed: Dec. 21, 2012

(86) PCT No.: PCT/JP2012/083360

§ 371 (c)(1),
(2) Date: Mar. 18, 2014

(87) PCT Pub. No.: WO2013/179520

PCT Pub. Date: Dec. 5, 2013

(65) Prior Publication Data

US 2014/0331528 A1 Nov. 13, 2014

(30) Foreign Application Priority Data

May 29, 2012 (JP) ..... 2012-121990

(51) Int. Cl.
*E02F 3/40* (2006.01)
*E02F 9/28* (2006.01)
*E02F 3/32* (2006.01)

(52) U.S. Cl.
CPC ..... *E02F 3/40* (2013.01); *E02F 9/2883* (2013.01); *E02F 3/325* (2013.01); *E02F 9/2825* (2013.01)

(58) Field of Classification Search
USPC ..... 37/446, 448, 450, 451
See application file for complete search history.

(56) References Cited

U.S. PATENT DOCUMENTS

| | | | | | |
|---|---|---|---|---|---|
| 3,621,594 | A | * | 11/1971 | Hahn et al. | 37/451 |
| 3,762,079 | A | * | 10/1973 | Lukavich et al. | 37/451 |
| 3,851,413 | A | * | 12/1974 | Lukavich | 37/451 |
| 3,974,579 | A | * | 8/1976 | Black et al. | 37/450 |
| 4,007,550 | A | * | 2/1977 | Stepe | 37/448 |
| 4,601,119 | A | * | 7/1986 | Klett | 37/448 |
| 5,063,696 | A | * | 11/1991 | Smith | 37/455 |
| 5,852,888 | A | * | 12/1998 | Cornelius | 37/457 |
| 6,070,345 | A | * | 6/2000 | Akaki et al. | 37/407 |
| 6,230,424 | B1 | * | 5/2001 | Renski et al. | 37/446 |
| 6,434,865 | B2 | * | 8/2002 | Renski et al. | 37/446 |
| 6,457,268 | B1 | * | 10/2002 | Perry et al. | 37/403 |

(Continued)

FOREIGN PATENT DOCUMENTS

| | | | |
|---|---|---|---|
| JP | 2004-183396 | A | 7/2004 |
| JP | 2011-58278 | A | 3/2011 |

OTHER PUBLICATIONS

International Search Report for a corresponding international application No. PCT/JP2012/083360, issued on Apr. 9, 2013.

(Continued)

*Primary Examiner* — Matthew D Troutman
(74) *Attorney, Agent, or Firm* — Global IP Counselors, LLP

(57) ABSTRACT

An excavating bucket includes a pair of left and right corner adapters that are fixed with respect to inclined parts provided on protruding parts at the left and right ends on the distal end side of a cutting edge. Tooth members are attached to the distal ends of the corner adapters for excavation. Distal end positions of the corner adapters are disposed on the same line as the distal end positions of a plurality of center adapters.

18 Claims, 8 Drawing Sheets

(56) References Cited

U.S. PATENT DOCUMENTS

| | | | | |
|---|---|---|---|---|
| 6,751,897 | B2 * | 6/2004 | Bierwith | 37/446 |
| 6,766,602 | B2 * | 7/2004 | Cox et al. | 37/448 |
| 7,673,403 | B2 * | 3/2010 | Bridges | 37/403 |
| 2001/0005950 | A1 * | 7/2001 | Renski et al. | 37/444 |
| 2002/0078607 | A1 * | 6/2002 | Perry et al. | 37/446 |
| 2004/0025381 | A1 | 2/2004 | Cox et al. | |
| 2004/0098886 | A1 * | 5/2004 | Hohmann et al. | 37/451 |
| 2006/0225313 | A1 * | 10/2006 | McClanahan et al. | 37/450 |
| 2008/0201995 | A1 * | 8/2008 | Browder | 37/450 |
| 2011/0289803 | A1 | 12/2011 | Folkerts et al. | |
| 2013/0318840 | A1 * | 12/2013 | Ollinger et al. | 37/444 |

OTHER PUBLICATIONS

A Notice of Allowance for the corresponding Korean patent application No. 10-2014-7010558, issued on Aug. 26, 2014.

* cited by examiner

EXCAVATING BUCKET FOR CONSTRUCTION MACHINE

CROSS-REFERENCE TO RELATED APPLICATIONS

This application is a U.S. National stage application of International Application No. PCT/JP2012/083360, filed on Dec. 21, 2012. This U.S. National stage application claims priority under 35 U.S.C. §119(a) to Japanese Patent Application No. 2012-121990, filed in Japan on May 29, 2012, the entire contents of which are hereby incorporated herein by reference.

BACKGROUND

1. Field of the Invention

The present invention relates to an excavating bucket for a construction machine.

2. Description of the Related Art

Various kinds of work implements are attached to a hydraulic excavator or other such construction machine according to the work to be done.

For example, with a hydraulic excavator, an excavating bucket is mounted as a work implement at the distal end of an arm. A plurality of adapters are provided to the distal end portion on the excavation side of the excavating bucket to protrude from the distal end portion. A plurality of replaceable teeth are attached to the adapters. When the hydraulic excavator is used for excavation, the teeth provided at the distal ends of this bucket on the excavation side function as cutting blades that pierce the material being excavated and enhance the excavation performance.

The adapters provided at the left and right ends of the bucket (corner adapters) are mounted on the inside of the bucket side plates if the bucket is to be mounted to a small or medium-sized hydraulic excavator. On the other hand, if the bucket is to be mounted to a large-sized hydraulic excavator, the excavating work at a bucket wall face is performed with teeth mounted to the left and right ends, so these teeth are attached sticking out from the side plates.

Japanese Laid-Open Patent Application 2011-58278 (laid open on Mar. 24, 2011), for example, discloses an excavating bucket having corner adapters that are welded to the cutting edge and the end faces of the bucket side plates with two straps to sandwich the cutting edge attached on an extension line of the bottom plate that is part of the bucket. This excavating bucket is configured so that the left and right portions at the distal end of the distal end are inclined rearward from the middle portion, the spreading angle of the corner adapters is the same as the spreading angle of the side plates, and the left and right adapter distal ends are pulled in more than the other adapter distal ends.

SUMMARY

However, the following problems are encountered with the conventional construction machine excavating buckets discussed above.

Specifically, with the construction machine excavating bucket disclosed in Japanese Laid-Open Patent Application 2011-58278 (laid open on Mar. 24, 2011), because the distal end positions of the corner adapters attached to the left and right ends are configured to locate behind those of the other adapters, the tip positions of the teeth at the left and right ends are also configured to locate behind the tip positions of the other teeth, which is a problem in that it makes it harder to create a uniform cutting face (excavation surface), and this makes the excavating work more difficult.

However, if the length of the corner adapter distal ends is merely increased in an effort to solve this problem, the ratio of the length of the distal ends to the weld length at the cutting edge, etc., will end up being too high. This puts a greater burden on the welded portion of the corner adapters because of the load exerted on the teeth in excavation work, and there is a risk that the corner adapters will break.

It is an object of the present invention to provide an excavating bucket for a construction machine, with which ease of work can be ensured while lessening the excessive load exerted on the welded portion of the corner adapters.

The excavating bucket for a construction machine pertaining to a first exemplary embodiment of present invention comprises a bottom plate whose ends in the width direction curve in a C shape, a pair of left and right side plates, a cutting edge, a plurality of adapters, and a pair of left and right corner adapters. The left and right side plates are attached to the ends of the bottom plate so as to spread out at a first angle with respect to the center line of the width direction of the bottom plate. The cutting edge has a distal end part, protruding parts that are adjacent to the two ends of the distal end part and incline away from the bottom plate, and an inclined part that is adjacent to the protruding part. This cutting edge is attached to the distal end portion on the excavation side of the bottom plate, and the inclined part is inclined with respect to the distal end part toward the left and right ends to approach the bottom plate at the first angle with respect to the distal end part. The plurality of adapters are fixed on the distal end side of the cutting edge, and tooth members used for excavation are attached to the distal ends thereof. The left and right corner adapters are fixed with respect to the protruding parts provided to the left and right ends on the distal end side of the cutting edge, tooth members used for excavation are attached to the distal ends thereof, and the distal end positions thereof are disposed on the same line as the distal end positions of the plurality of adapters.

An excavating bucket that is used, for example, as a ground engaging tool of a work implement on a hydraulic excavator or other such construction machine, includes a plurality of adapters attached to a cutting edge provided on the distal end side at the excavation side of a bottom plate constituting the box shape of the bucket, and to the distal end of which are mounted tooth members, and of these adapters, the corner adapters attached to protruding parts formed at the left and right ends of the cutting edge are fixed as follows.

With this excavating bucket, the left and right corner adapters are disposed so that their distal end positions are aligned on the same line as the other adapters. Furthermore, with this excavating bucket, these corner adapters are attached to the protruding parts formed to protrude forward beyond the portion of the cutting edge where the other adapters are attached to compensate for how much they are recessed by the inclined part.

Consequently, if the length of the distal end portion of the corner adapters is the same as that of the distal end portion of the other adapters, the distal end positions of the corner adapters can be aligned on the same line as the distal end positions of the other adapters. Thus, the load exerted on the welded portions of the cutting edge, etc., will not be increased as much when the corner adapters are made longer than the distal end parts of the other adapters.

The excavating bucket for a construction machine pertaining to a second exemplary embodiment of the present invention is the excavating bucket for a construction machine pertaining to the first exemplary embodiment of the present invention, further comprising joints at which the corner adapters are joined by continuous welding only to the cutting edge.

Here, the corner adapters are not continuously welded to the side plates, but are instead continuously welded only to the cutting edge.

Consequently, because there is no continuous welding of the side plates that form the box structure of the excavating bucket and only the cutting edge is being continuously welded, the job of replacing the corner adapters when they have worn out, etc., is easier to carry out.

The excavating bucket for a construction machine pertaining to a third exemplary embodiment of the present invention is the excavating bucket for a construction machine pertaining to the second exemplary embodiment of the present invention, wherein the joints are constituted by first joints at which the upper face of the cutting edge and the corner adapters are joined by continuous welding, and second joints at which the lower face of the cutting edge and the corner adapters are joined by continuous welding.

Here, two welded portions (first and second joints) provided to the upper and lower faces are used as the joints at which the cutting edge is welded to the pair of left and right corner adapters.

Consequently, there are few welds on the corner adapters, which means that the job of replacing the adapters can be carried out more easily.

The excavating bucket for a construction machine pertaining to a fourth exemplary embodiment of the present invention is the excavating bucket for a construction machine pertaining to any of the first to third exemplary embodiments of the present invention, wherein the left and right corner adapters have recesses into which the side plates are inserted.

Here, the corner adapters are fixed by welding to the cutting edge, etc., in a state in which the side plates have been inserted into recesses of a portion branching in two.

Consequently, the corner adapters can be disposed so that the tooth members bulge outwardly from the side plates.

With the excavating bucket of a construction machine pertaining to an exemplary embodiment of the present invention, the distal end positions of the left and right corner adapters can be aligned on the same line as the distal end positions of the other adapters, and the excessive load exerted on the welded portions of the corner adapters can be reduced.

DETAILED DESCRIPTION OF EXEMPLARY EMBODIMENTS

The excavating bucket for a construction machine pertaining to an exemplary embodiment of the present invention is described with reference to FIGS. 1 to 8.

Figure 2:
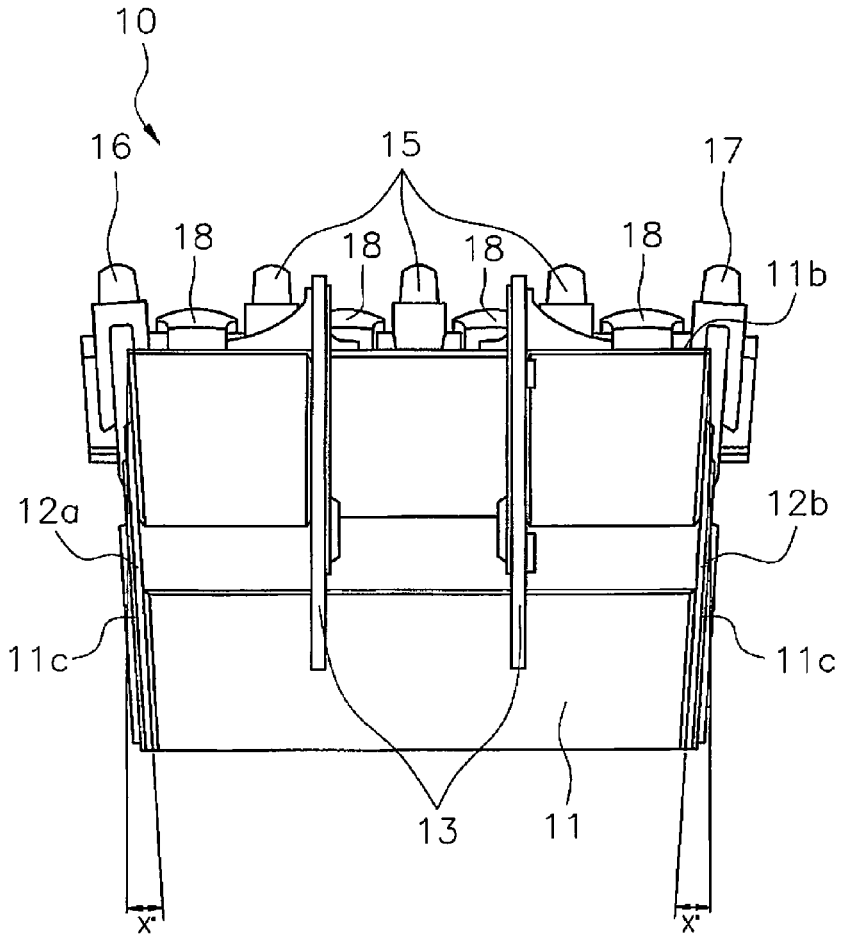
FIG. 2 is a rear view of the excavating bucket of FIG. 1.

The "rear view" of the excavating bucket 10 that appears in the following description, means that when the opening of the excavating bucket 10 is facing up, as shown in FIG. 2, the excavating bucket 10 is viewed from a mounting component 13 side at a position where the opening end face looks like a straight line. The left and right direction will be called the "width direction," using the excavating bucket 10 in rear view as a reference.

Structure of Excavating Bucket 10

Figure 1:
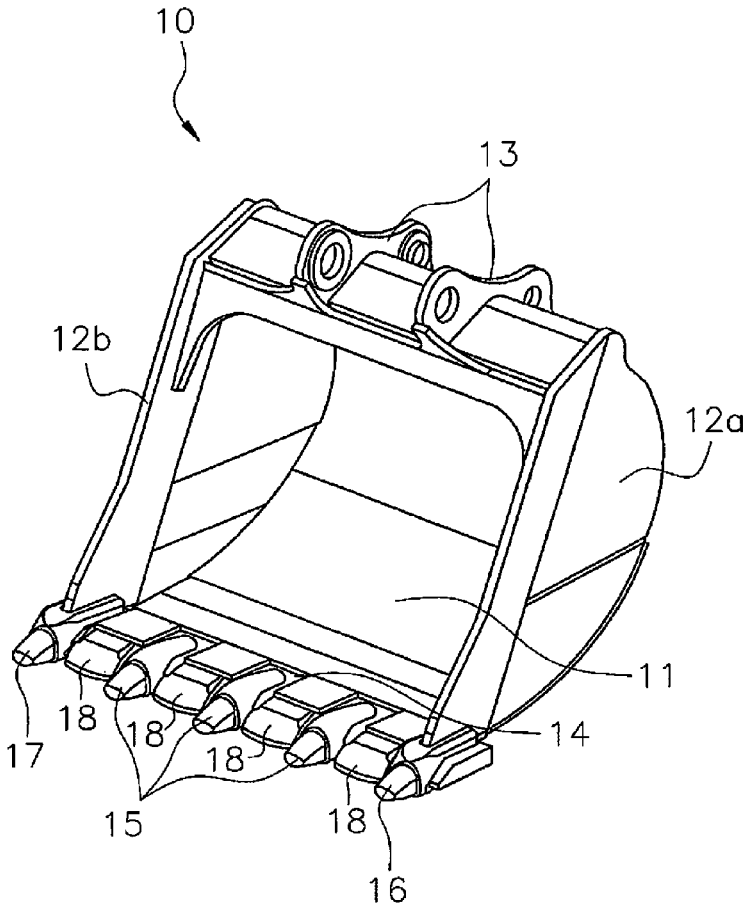
FIG. 1 is an overall oblique view of the configuration of the excavating bucket of a construction machine pertaining to an exemplary embodiment of the present invention.

The excavating bucket 10 in this exemplary embodiment is a ground engaging tool that is mounted at the distal end of an arm of a hydraulic excavator or other such construction machine, and is driven by a hydraulic cylinder. As shown in FIG. 1, this excavating bucket 10 comprises a bottom plate 11, a pair of left and right side plates 12*a* and 12*b*, the mounting component 13, a cutting edge 14, center adapters 15, corner adapters 16 and 17, and shrouds 18.

Figure 3:
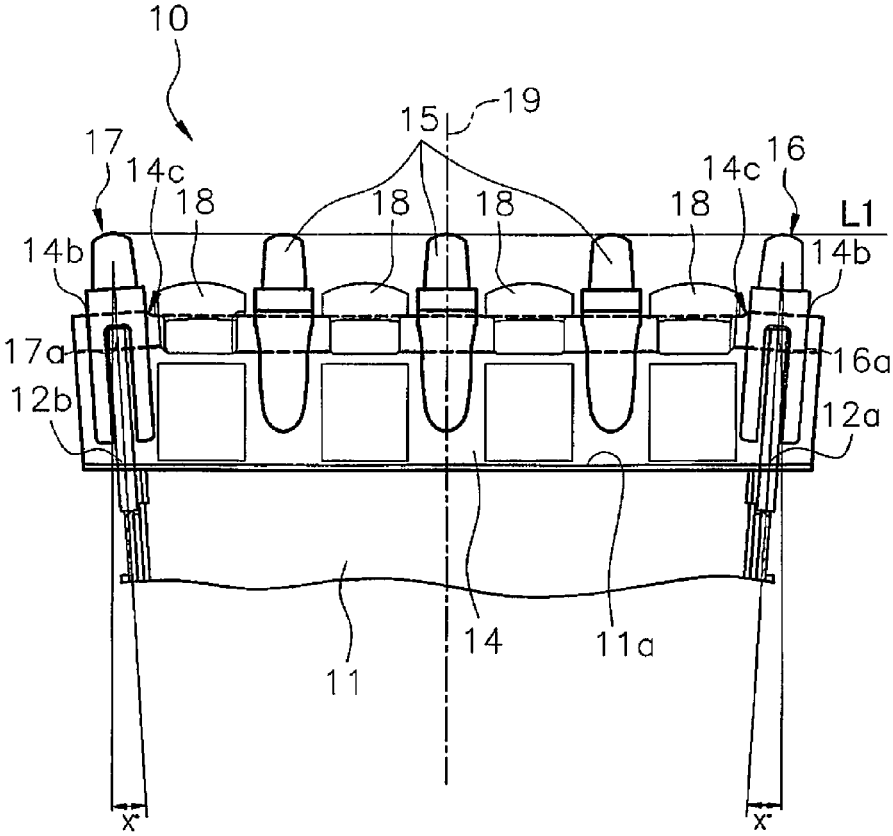
FIG. 3 is a detail view of the distal end portion on the excavation side of the excavating bucket of FIG. 1.
Figure 4:
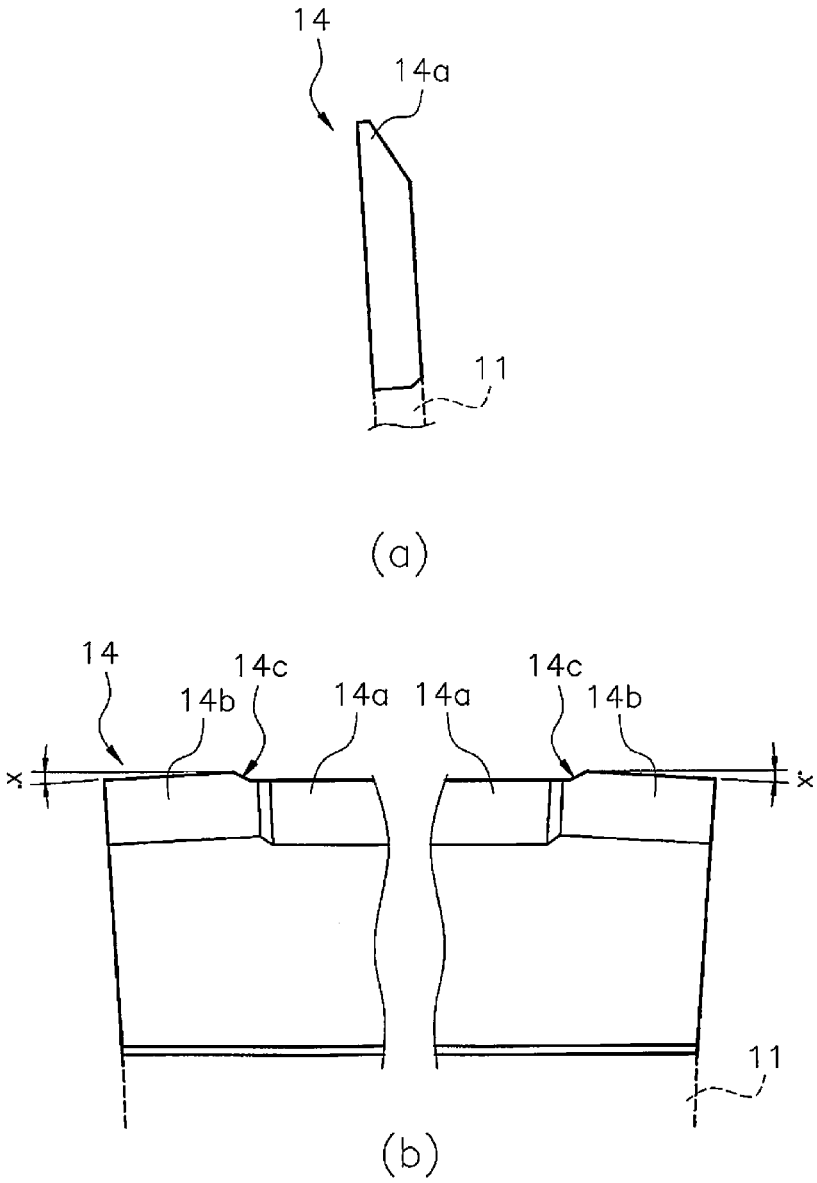
FIGS. 4*a* and 4*b* are a side view and a detail plan view of the cutting edge included in the excavating bucket of FIG. 1.

The bottom plate 11 is a flat member that forms the bottom face of the box structure of the excavating bucket 10 along with the left and right side plates 12*a* and 12*b*. The bottom plate 11 has substantially linear ends 11*a* and 11*b*, and lateral ends 11*c* that are curved in a C shape toward the back of the box structure. Also, the plurality of center adapters 15 and the corner adapters 16 and 17 are provided at one end on the excavation side of the bottom plate 11. As shown in FIG. 3, the bottom plate 11 has a center line 19 defined as the center in the width direction, that is, the center between the two lateral ends 11*c* (FIG. 2).

The left and right side plates 12*a* and 12*b* are flat members that are attached to the side ends 11*c* of the bottom plate 11 to block the curved bottom plate 11 from the left and right sides, and form the box structure along with the bottom plate 11. With the excavating bucket shown in rear view in FIG. 2, the side plates 12*a* and 12*b* spread out at a specific angle (first angle) X° with respect to the direction in which they are parallel to the center line 19 of the bottom plate 11, so that the opening of the box structure widens from the back toward the excavation side. The opening in the box structure formed by the side plates 12*a* and 12*b* and the ends 11*a* and 11*b* of the bottom plate 11 has a substantially rectangular shape.

The spreading shape of the excavating bucket 10 facilitates breaking up soil inside the bucket, particularly with an excavating bucket mounted to a large hydraulic excavator or the like.

In this exemplary embodiment, the specific angle X° is set to 3.5°, but this is not the only option.

The mounting component 13 is provided on the outside of the box structure, on the opposite side portion (the end 11*b*) of the bottom plate 11 from the excavation side. When the excavating bucket 10 is mounted to the distal end of the arm on a hydraulic excavator or the like, the mounting component 13 is supported pivotably with respect to the arm distal end. This allows the portion of the excavating bucket 10 pivotably supported on the arm distal end to be rotated around the center by the driving force of the hydraulic cylinder.

As shown in FIG. 3, the cutting edge 14 is a flat member provided to the distal end on the excavation side of the bottom plate 11, and as shown in FIG. 4*a*, has a wedge-shaped cross section that narrows toward the distal end on the excavation side. As shown in FIG. 4*b*, the cutting edge 14 has a distal end part 14*a*, inclined parts 14*b*, and protruding parts 14*c*, at both ends in the width direction of the distal end portion on the excavation side (wedge-shaped). The cutting edge 14 (this flat member) is cut out from a single plate of material. Alternatively, it may be formed by welding together a plurality of plates, such as a member including the distal end part 14*a* and members including the inclined parts 14*b*.

As shown in FIGS. 3 and 4*b*, the distal end part 14*a* is a linear portion that is perpendicular to the center line 19 of the bottom plate 11 formed in the approximate center on the excavation side of the cutting edge 14, and to this are attached the plurality of center adapters 15, as described below.

The protruding parts 14*c* are provided adjacent to the two ends of the distal end part 14*a*. The protruding parts 14*c* are linear portions that are inclined away from the distal end of the bottom plate 11 as they move farther from the end of the distal end part 14*a*.

As shown in FIG. 4*b*, the inclined parts 14*b* are distal end portions that are adjacent to the protruding parts 14*c* and that approach the bottom plate 11 toward the left and right ends of the cutting edge 14, and to these are attached the left and right corner adapters 16 and 17, as described below. The inclination angle of these inclined parts 14*b* is an angle with respect to an extension line from the distal end part 14*a*, and is formed to substantially coincide with the above-mentioned specific angle X°. Specifically, when the inclined parts 14*b* are provided, the corner adapters 16 and 17 can be spread out to match the specific angle X°, which spreads out from the left and right side plates 12*a* and 12*b*, merely by attaching the corner adapters 16 and 17 to the inclined parts 14*b* of the cutting edge 14.

As discussed above, the protruding parts 14*c* are portions that stick out beyond the distal end part 14*a* at the distal end on the excavation side of the cutting edge 14, and are provided to the left and right ends of the cutting edge 14 to compensate for how much they are recessed by the inclined part from the extension of the distal end part 14*a*. That is, the protruding parts 14*c* are such that even when the corner adapters 16 and 17 attached to the inclined parts 14*b* have the same distal end length as the center adapters 15, the distal end positions of the corner adapters 16 and 17 and the center adapters 15 can be aligned on the same line L1, as shown in FIG. 3.

Excavation-use tooth members (not shown) are attached to the distal end parts of the center adapters 15 and the corner adapters 16 and 17. Because the tooth members are consumables that wear out in the course of excavation work and so on, they are attached to the center adapters 15 and the corner adapters 16 and 17 via pins or the like so that they can be replaced.

Figure 5:
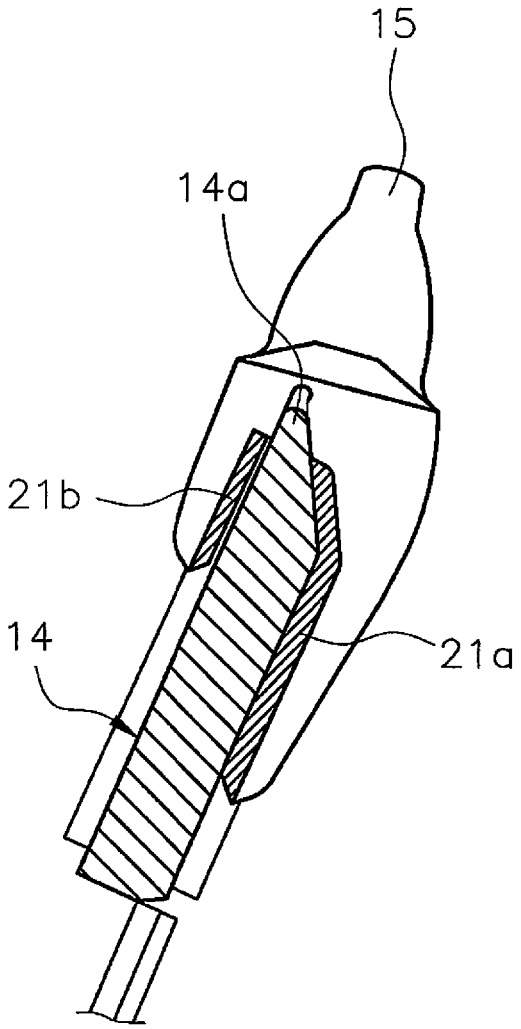
FIG. 5 is a cross section of the configuration of the attachment portion of a center adapter included in the excavating bucket of FIG. 1.

The center adapters 15 are a plurality of adapter members obtained by excluding the corner adapters 16 and 17 attached to the left and right ends, as described below, from the plurality of adapter members attached to the distal end of the cutting edge 14 on the excavation side. As shown in FIG. 5, the center adapters 15 are continuously welded to the cutting edge 14 at joints 21*a* on the upper face side of the cutting edge 14 and joints 21*b* on the lower face side to sandwich the distal end portion of the cutting edge 14 on the excavation side.

As shown in FIG. 3 and elsewhere, the corner adapters 16 and 17 are mounted to the left and right ends, out of the plurality of adapter members attached to the distal end of the cutting edge 14 on the excavation side. That is, the corner adapters 16 and 17 are attached to the inclined parts 14*b* provided to the left and right ends of the cutting edge 14. Accordingly, the corner adapters 16 and 17 are attached in a state of being spread out by the angle at which the inclined parts 14*b* are inclined with respect to the extension line of the distal end part 14*a*.

Also, the corner adapters 16 and 17 are disposed to stick out beyond the left and right side plates 12*a* and 12*b*, as shown in FIG. 2, etc., to use the tooth members at the left and right ends to perform excavation work on a wall face or the like with the excavating bucket mounted to a large-sized hydraulic excavator or the like. In other words, the corner adapters 16 and 17 are attached to portions where the side plates 12*a* and 12*b* and the cutting edge 14 (bottom plate 11) intersect each other. Therefore, as shown in FIG. 3, the corner adapters 16 and 17 respectively have recesses 16*a* and 17*a* into which the side plates 12*a* and 12*b* are inserted in an attached state.

Figure 6:
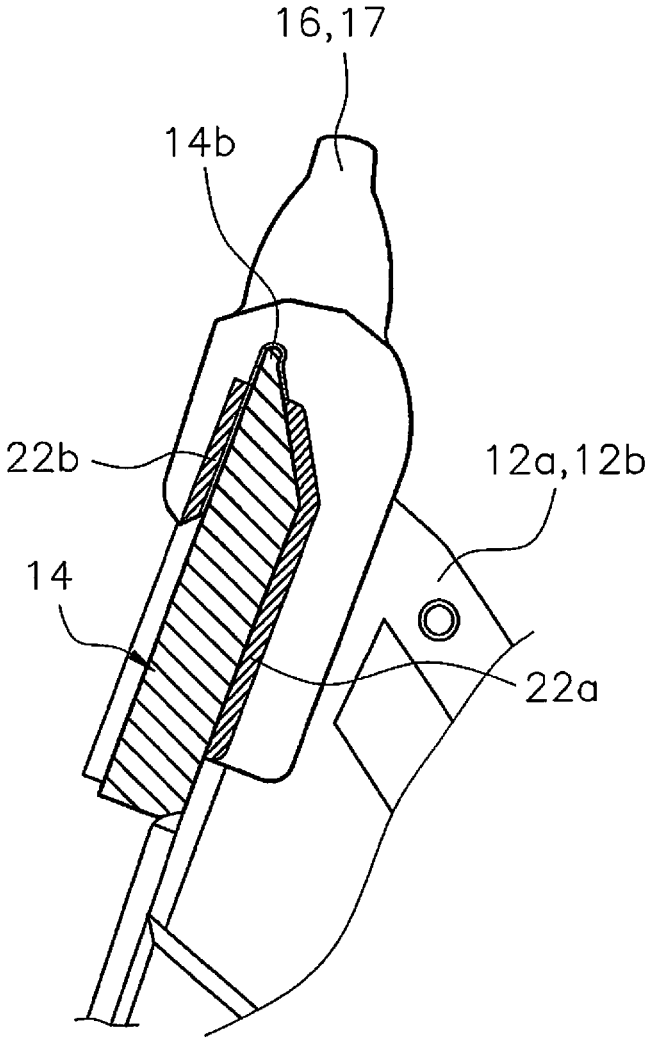
FIG. 6 is a cross section of the configuration of the attachment portion of a corner adapter included in the excavating bucket of FIG. 1.

The corner adapters 16 and 17 are continuously welded via joints 22*a* and 22*b*, respectively, to the upper and lower face sides of the cutting edge 14 as shown in FIG. 6 in a state in which the side plates 12*a* and 12*b* are respectively inserted into the recesses 16*a* and 17*a* formed in the center of a portion branching in two.

Figure 7:
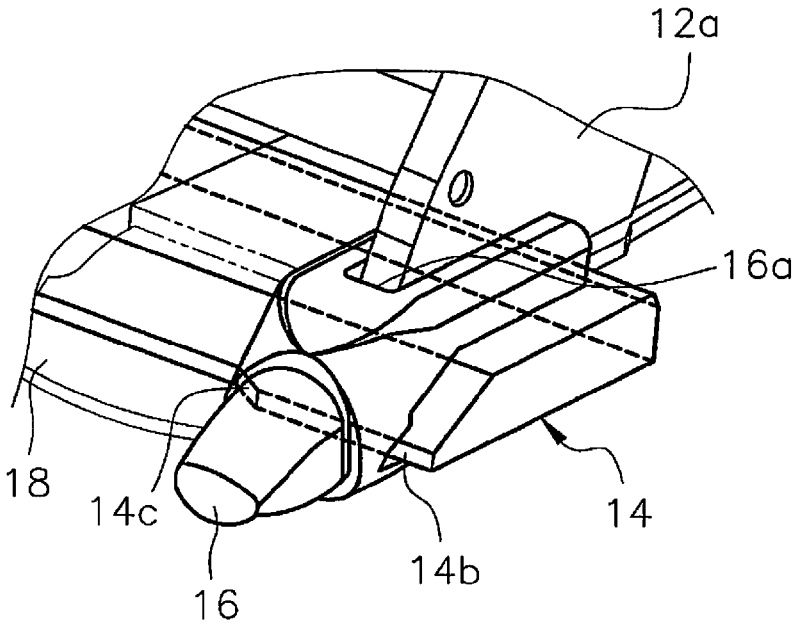
FIG. 7 is an oblique view of the configuration around the right corner adapter included in the excavating bucket of FIG. 1.

More specifically, as shown in FIG. 7, the corner adapter 16 disposed at the right end of the excavating bucket 10 is provided to the portion where the right side plate 12*a* and the cutting edge 14 intersect, and is attached so that the side plate 12*a* is inserted into the recess 16*a* formed in the center between the two branches, and the cutting edge 14 is sandwiched in between. As shown in FIG. 6, the corner adapter 16 here is not welded to the side plate 12*a*, and is continuously welded only to the upper and lower faces of the cutting edge 14. In this exemplary embodiment, the reason for using continuous welding rather than intermittent welding is to obtain better joint strength that can withstand the stress produced during excavation.

Figure 8:
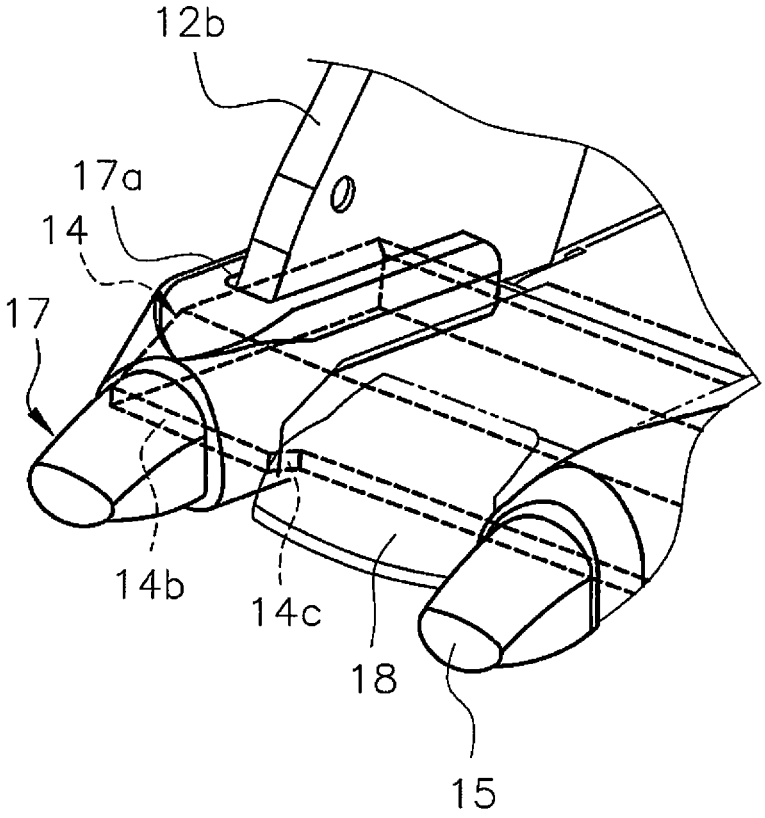
FIG. 8 is an oblique view of the configuration around the left corner adapter included in the excavating bucket of FIG. 1.

As shown in FIG. 8, meanwhile, the corner adapter 17 disposed at the left end of the excavating bucket 10 is provided to the portion where the left side plate 12*b* and the cutting edge 14 intersect, and is attached so that the side plate 12*b* is inserted into the recess 17*a* formed in the center between the two branches, and the cutting edge 14 is sandwiched in between. As shown in FIG. 6, the corner adapter 17 here is not welded to the side plate 12*b*, and is continuously welded only to the upper and lower faces of the cutting edge 14.

With the excavating bucket 10 in this exemplary embodiment, because the left and right side plates 12*a* and 12*b* are directly welded to the cutting edge 14 at the portion where the side plates 12*a* and 12*b* and the cutting edge 14 intersect, the corner adapters 16 and 17 do not function as strength members for ensuring the stiffness of the excavating bucket 10. Thus, there is no need to use the corner adapters as part of the strength members of the excavating bucket, as was the case with a conventional configuration in which the corner adapters and the side plates were welded together. As a result, with the configuration in this exemplary embodiment, adequate stiffness of the excavating bucket 10 can be ensured merely by continuously welding the corner adapters 16 and 17 to just the cutting edge 14, rather than welding them to the side plates 12*a* and 12*b*.

As shown in FIG. 3 and elsewhere, the shrouds 18 are provided between the center adapters 15 and between the left and right corner adapters 16 and 17 and the center adapters 15, and are welded to the distal end portion on the excavation side of the cutting edge 14, just as with the adapters 15, 16, and 17.

As shown in FIG. 3, with the excavating bucket 10 in this exemplary embodiment, the corner adapters 16 and 17, as described above, are attached to the inclined parts 14*b* provided on the protruding parts 14*c* at the left and right ends of the cutting edge 14, so that the distal ends of the corner adapters 16 and 17 are disposed on the same line L1 as the distal ends of the center adapters 15.

Accordingly, even when adapters of the same distal end length as the plurality of center adapters 15 are used as the corner adapters 16 and 17, the position of the distal ends of the corner adapters 16 and 17 can be aligned on the same line L1 as the position of the distal ends of the center adapters 15 even though the inclined parts 14*b* are recessed from the distal end on the excavation side. Thus, a uniform excavation face can be formed during excavation work in a state in which shared tooth members have been mounted to the center adapters 15 and the corner adapters 16 and 17.

As shown in FIG. 3, the excavating bucket 10 in this exemplary embodiment comprises the bottom plate 11 whose ends curve in a C shape in the width direction. The pair of left and right side plates 12*a* and 12*b* are attached to the ends of the bottom plate 11 to spread out at a specific angle X° with respect to the center line of the bottom plate 11 in the width direction. A cutting edge 14 includes the distal end part 14*a*, the protruding parts 14*c*, which are inclined away from the bottom plate 11 and are adjacent to the two ends of the distal end part 14*a*, and the inclined parts 14*b*, which are adjacent to the protruding parts 14*c*. The cutting edge 14 is attached to the distal end portion of the bottom plate 11 on the excavation side, and is inclined so that the inclined parts 14*b* approach the bottom plate 11 at the specific angle X° with respect to the distal end part 14*a* toward the left and right ends. A plurality of center adapters 15 are fixed to the distal end 14*a* of the cutting edge 14, and to the distal ends of which are attached excavation-use tooth members. As shown in FIGS. 7 and 8, the excavating bucket 10 also comprises a pair of left and right corner adapters 16 and 17 that are fixed to the inclined parts 14*b* provided on the protruding parts 14*c* at the left and right ends on the distal end side of the cutting edge 14, to the distal ends of which are attached excavation-use tooth members, with the distal end position being disposed on the same line as the distal end position of the plurality of center adapters 15.

Consequently, with the excavating bucket 10 in this exemplary embodiment, because the inclined parts 14*b*, which are inclined to spread out the corner adapters 16 and 17, are provided on the protruding parts 14*c* provided at the left and right ends of the cutting edge 14, the protruding parts 14*c* can compensate for the portion recessed by the inclined parts 14*b*. Thus, even when the corner adapters 16 and 17 have the same distal end length as the center adapters, the distal end positions can be aligned on the same line L1. Furthermore, because the length of the distal end portion with respect to the length of the welded portion of the corner adapters 16 and 17 can be made the same as that of the center adapters 15, the excessive load exerted on the joints 22*a* and 22*b* where the corner adapters 16 and 17 are welded can be reduced.

As shown in FIG. 6, the excavating bucket 10 in this exemplary embodiment comprises the joints 22*a* and 22*b* where the corner adapters 16 and 17 are continuously welded to the cutting edge 14.

Consequently, should the corner adapters 16 and 17 need to be replaced due to wear, etc., the work entailed by replacing the corner adapters 16 and 17 can be carried out more easily than in the past since the corner adapters 16 and 17 are not welded to the side plates 12*a* and 12*b*.

As shown in FIG. 6, with the excavating bucket 10 in this exemplary embodiment, when the corner adapters 16 and 17 are welded to the upper and lower faces of the cutting edge 14, they are continuously welded via the joints 22*a* and 22*b*.

Consequently, the corner adapters 16 and 17 are welded to the cutting edge 14 with the minimum number of welds, taking into account the load that will be exerted on the corner adapters 16 and 17 during excavation work and so forth, and this allows the job of replacing worn out corner adapters 16 and 17 to be completed more easily.

As shown in FIGS. 7 and 8, with the excavating bucket 10 in this exemplary embodiment, the left and right corner adapters 16 and 17 have the recesses 16*a* and 17*a* into which the side plates 12*a* and 12*b* are inserted.

Consequently, the corner adapters 16 and 17 can be continuously welded to the cutting edge 14 in a state in which the side plates 12*a* and 12*b* have been inserted into the recesses 16*a* and 17*a* of the branched corner adapters 16 and 17.

Other Embodiments

An exemplary embodiment of the present invention was described above, but the present invention is not limited to or by the above embodiment, and various modifications are possible without departing from the gist of the invention.

In the above exemplary embodiment, an example was given in which the left and right corner adapters 16 and 17 were not welded to the side plates 12*a* and 12*b*, and were continuously welded only to the cutting edge 14, but the present invention is not so limited.

For example, the present invention may also be applied to a configuration in which the left and right corner adapters are welded to both the cutting edge and the left and right side plates.

Nevertheless, when replacement of the corner adapters due to wear or the like is taken into account, it is preferable from the standpoint of ease of work if the corner adapters are not continuously welded to the side plates, but rather welded intermittently, and only continuously welded to the cutting edge.

In the above exemplary embodiment, an example was given in which the corner adapters 16 and 17 were welded at two places: on the upper face side (joint 22*a*) and the lower face side (joint 22*b*) of the cutting edge 14, respectively. The present invention is not, however, so limited.

For example, the portion of the corner adapters joined to the cutting edge is not limited to being on the upper and lower face sides, and welds may be made at other portions, such as the side faces. Also, the components may be joined by welding at one place, or at three or more places.

In the above exemplary embodiment, an example was given in which the excavating bucket 10 had three center adapters 15. The present invention is not, however, limited to this.

For example, the present invention can of course be applied to an excavating bucket having two center adapters 15, or one having four or more.

In the above exemplary embodiment, an example was given in which the excavating bucket was mounted to the distal end of an arm of a hydraulic excavator. The present invention is not, however, so limited.

For example, the present invention can also be applied to an excavating bucket that is mounted to some other type of construction machine.

The effect of the construction machine excavating bucket of the present invention is that the excessive load exerted on the welded portions of the corner adapters can be reduced while having the distal end position of the left and right corner adapters aligned on the same line as the distal end position of the other adapters, which allows this invention to be widely applied to excavating buckets mounted to various kinds of construction machine.

The invention claimed is:

1. An excavating bucket of a construction machine, comprising:

a bottom plate whose ends in the width direction curve in a C shape;

a pair of left and right side plates that along with the bottom plate form a box structure having a bottom part and an opening, the left and right side plates being attached to the ends of the bottom plate and forming a first angle with respect to a center line of the width direction of the bottom plate;

a cutting edge attached to a distal end portion on an excavation side of the bottom plate, the cutting edge having a distal end part forming a widthwise center portion of the cutting edge, a pair of protruding parts disposed adjacent to the two widthwise opposite ends of the distal end part and protruding farther away from the bottom plate than the distal end part, and a pair of inclined parts disposed adjacent to the widthwise outside ends of the protruding parts such that each of the protruding parts is disposed between the distal end part and one of the inclined parts, each of the inclined parts being inclined at the first angle with respect to the distal end part such that a widthwise outer end of the inclined part is closer to the bottom plate than a widthwise inner end of the inclined part;

a plurality of adapters fixed on the distal end side of the cutting edge, the adapters being configured to have tooth members attached to distal ends thereof to be used for excavation; and a pair of left and right corner adapters fixed with respect to the pair of inclined parts of the cutting edge, the corner adapters being configured to have tooth members attached to distal ends thereof to be used for excavation, the left and right corner adapters being arranged and configured such that distal end positions of the left and right corner adapters are disposed on a same line as distal end positions of the plurality of adapters.

2. The excavating bucket of a construction machine according to claim 1, further comprising joints at which the pair of left and right corner adapters are joined by continuous welding only to the cutting edge.

3. The excavating bucket of a construction machine according to claim 2, wherein the joints are constituted by first joints at which an upper face of the cutting edge and the pair of left and right corner adapters are joined by continuous welding, and second joints at which a lower face of the cutting edge and the corner adapters are joined by continuous welding.

4. The excavating bucket of a construction machine according to claim 1, wherein the pair of left and right corner adapters have recesses into which the side plates are inserted.

5. The excavating bucket of a construction machine according to claim 2, wherein the pair of left and right corner adapters have recesses into which the side plates are inserted.

6. The excavating bucket of a construction machine according to claim 3, wherein the pair of left and right corner adapters have recesses into which the side plates are inserted.

7. The excavating bucket of a construction machine according to claim 1, wherein the left and right corner adapters are fixed to the inclined parts such that the left and right corner adapters are angled outward in the widthwise direction of the bottom plate at the first angle with respect to the center line.

8. The excavating bucket of a construction machine according to claim 2, wherein the left and right corner adapters are fixed to the inclined parts such that the left and right corner adapters are angled outward in the widthwise direction of the bottom plate at the first angle with respect to the center line.

9. The excavating bucket of a construction machine according to claim 3, wherein the left and right corner adapters are fixed to the inclined parts such that the left and right corner adapters are angled outward in the widthwise direction of the bottom plate at the first angle with respect to the center line.

10. The excavating bucket of a construction machine according to claim 1, wherein the cutting edge extends along an entire widthwise length of the distal end of the bottom plate.

11. The excavating bucket of a construction machine according to claim 10, wherein the cutting edge is made of a single plate of material.

12. The excavating bucket of a construction machine according to claim 10, wherein the cutting edge is disposed between the distal end of the bottom plate and the plurality of adapters.

13. The excavating bucket of a construction machine according to claim 2, wherein the cutting edge extends along an entire widthwise length of the distal end of the bottom plate.

14. The excavating bucket of a construction machine according to claim 13, wherein the cutting edge is made of a single plate of material.

15. The excavating bucket of a construction machine according to claim 13, wherein the cutting edge is disposed between the distal end of the bottom plate and the plurality of adapters.

16. The excavating bucket of a construction machine according to claim 3, wherein the cutting edge extends along an entire widthwise length of the distal end of the bottom plate.

17. The excavating bucket of a construction machine according to claim 16, wherein the cutting edge is made of a single plate of material.

18. The excavating bucket of a construction machine according to claim 16, wherein the cutting edge is disposed between the distal end of the bottom plate and the plurality of adapters.

* * * * *